United States Patent [19]

Schiek et al.

[11] 4,085,391

[45] Apr. 18, 1978

[54] MICRO-STRIP TO A SLOTTED LINE TRANSDUCER

[75] Inventors: Burkhard Schiek, Halstenbek, Germany; Frans Christiaan De Ronde, Eindhoven, Netherlands

[73] Assignee: U.S. Philips Corporation, New York, N.Y.

[21] Appl. No.: 730,163

[22] Filed: Oct. 7, 1976

[30] Foreign Application Priority Data

Oct. 18, 1975 Germany ..... 2546836

[51] Int. Cl.[2] ..... H01P 5/08

[52] U.S. Cl. ..... 333/33; 333/84 M

[58] Field of Search ..... 333/10, 11, 21, 84 R, 333/84 M, 33

[56] References Cited

U.S. PATENT DOCUMENTS 3,946,339 3/1976 Oltman, Jr. et al. ..... 333/11

*Primary Examiner*—Paul L. Gensler

*Attorney, Agent, or Firm*—Algy Tamoshunas; Frank R. Trifari

[57] ABSTRACT

Planar transducer for microwaves from a micro-strip line to a slotted line, in which a microwave strip line junction in the form of a "Y" is disposed on the upper side of a substrate, one of the strip line branches being short-circuited, the other one being open, and that a slotted line in the form of a Y, which is in the opposite direction of the first Y, is disposed at the bottom side of the substrate, one slotted line branch being open, the other being short-circuited, whereas the centers of the "Y"-structures coincide exactly.

2 Claims, 1 Drawing Figure

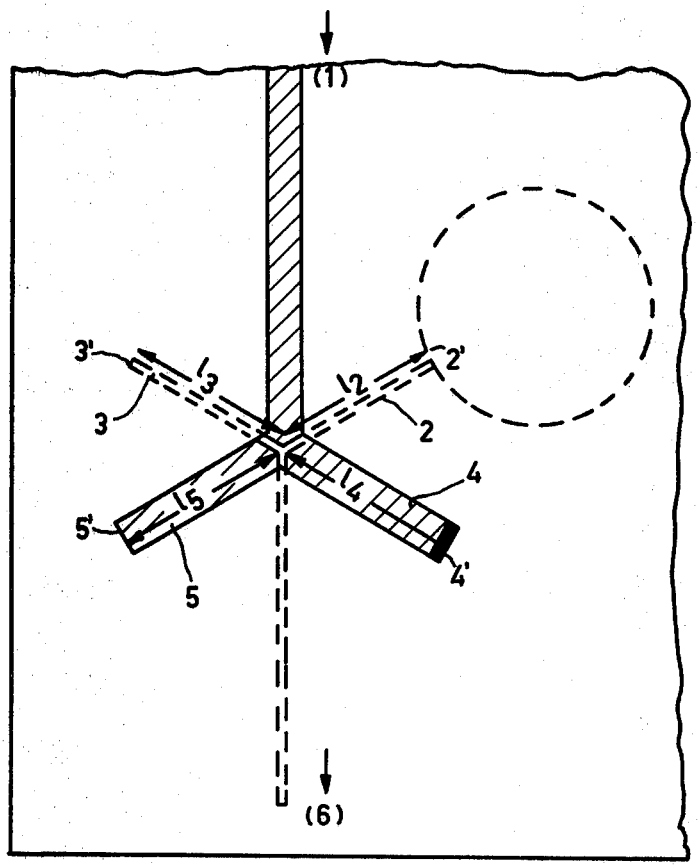
(1)
3'
3
l3
l2
2'
2
4
l4
l5
5'
5
4'
(6)

MICRO-STRIP TO A SLOTTED LINE TRANSDUCER

The invention relates to a planar transducer for microwaves from a micro-strip to a slotted line.

In the designing of integrated microwave circuits the combination of micro-strip and slotted lines offers considerable advantages.

A well-matched, low-loss transducer from micro-strip line to slotted line is consequently an important element in this planar technique. It is known to effect such a transition by having the slotted line, which ends in an open circuit cross a micro-strip line, which in its turn, ends in a shorted circuit. The slotted line is disposed in the metallized bottom side of a substrate, the micro-strip line is disposed on top.

However, in the practical construction this transducer is not very advantageous as the losses are comparatively large and also the matching and the bandwidth which can be achieved are not satisfactory. The reason for this less than optimum behaviour of this transducer is in the fact that the open circuit of the slotted line and the short-circuit of the micro-strip line cannot be placed close enough to the crossing due to electrical and mechanical reasons.

It is an object of the invention to provide an improved transducer of the above-mentioned type.

In accordance with the invention this is realized because there is on one side of a substrate a microwave strip line junction in the form of an "Y," one of the strip line branches being open and the other short-circuited, and on the other side there is a slotted waveguide junction in the form of an "Y" which is in the opposite direction with respect to the first-mentioned "Y," one of the slotted line branches being open and the other short-circuited, the centers of the Y-structures being coincident.

An embodiment will be described by way of example with reference to the only FIGURE of the diagrammatic drawing.

A microwave circuit in which the micro-strip line and the slotted line are in the form of coinciding, oppositely-directed "Y"-structures has the following properties: An input signal at port 1 of the micro-strip line is sent in equal portions into the branches 2, 3, 4 and 5, provided all lines, that is to say the slotted lines as well as the microstrip lines have the same characteristic impedance, for example 50 Ohms. In the case the port 1 is matched, if the branches 2, 3, 4 and 5 are terminated, in their turn, in the characteristic impedance. Port 1 and port 6 are uncoupled. If the signals sent into the branches are all allowed to reflect totally with the same phase then all signals are again added together to a total reflection at port 1.

A similar operation applies for the supply of a signal from port 6 of the slotted line. The input signal is sent in equal portions into the branches 2, 3, 4 and 5, however in the opposite phase in the branches 2 and 5 with respect to the branches 3 and 4. If all the signals sent in are allowed to reflect totally with the same phase then all signals are added together again to one signal in the slotted line at port 6. The signal transport to port 1 or port 6, which depends on the mutual phase in the junction may be utilized as follows. If a signal is applied to port 1 and the branches 2 and 5 have the reflection factor $\exp(j\varphi)$ and the branches 3 and 4 the reflection factor $\exp(j\varphi + 180°)$ or vice versa then all energy is sent into the slotted line of port 6.

A difference of 180° in the reflection factor can now be obtained by chosing either shorted circuits or open circuits.

An improved transducer from a micro-strip line to a slotted line can be obtained because the micro-strip line branch 4 of the length $l_4$ is short-circuited at the end 4', and the end of the micro-strip, line branch 5 of the length $l_5$ is open. The ends 2' and 3' respectively, of the slotted line branches 2 and 3 respectively are of the lengths of $l_2$ and $i_3$ respectively and are open or short-circuited respectively, as shown. It preferable if the lengths $l_2, l_3, l_4$ and $l_5$ are of the same electrical length. The "Y"-shaped slotted lines are coupled to the "Y" shaped strip lines and the centres of the "Y"-structures are coincident. Furthermore the micro-strip lines and the slotted lines preferably have the same characteristic impedance.

What is claimed is:

1. A planar transducer for microwaves from a micro-strip line to a slotted line, wherein on one side of a dielectric substrate there is a microwave strip line junction in the form of a "Y," one strip line branch being short-circuited, the other strip line branch being open, and that at the other side of the substrate there is a slotted line junction in the form of an oppositely directed "Y," one slotted line branch being open, the other slotted line branch being short-circuited, and wherein the centres of the Y-structures coincide.

2. A planar transducer as claimed in claim 1, wherein considered electrically, the open and shorted circuits are equidistant from the centres of the Y-structures, and the micro-strip lines and the slotted lines have the same characteristic impedance.

* * * * *

UNITED STATES PATENT OFFICE

CERTIFICATE OF CORRECTION

Patent No. 4,085,391 Dated April 18, 1978

Inventor(s) BURKHARD SCHIENK ET AL

It is certified that error appears in the above-identified patent and that said Letters Patent are hereby corrected as shown below:

Column 2, line 27, "$i_3$" should be --$l_3$--

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*